United States Patent [19]

Tabuchi

[11] Patent Number: 4,541,622

[45] Date of Patent: Sep. 17, 1985

[54] RECLINING BED FOR CHILDBIRTH

[75] Inventor: Akiko Tabuchi, Okayama, Japan

[73] Assignee: Kazuhisa Tabuchi, Okayama, Japan

[21] Appl. No.: 565,014

[22] Filed: Dec. 22, 1983

[51] Int. Cl.[4] ..... A61G 13/00

[52] U.S. Cl. ..... 269/325

[58] Field of Search ..... 269/322–328; 5/60–69

[56] References Cited

U.S. PATENT DOCUMENTS

| | | | |
|---|---|---|---|
| 3,614,085 | 10/1971 | Cunningham | 269/323 |
| 4,139,917 | 2/1979 | Fenwick | 269/325 |
| 4,221,370 | 9/1980 | Redwine | 269/323 |
| 4,225,127 | 9/1980 | Strutton | 269/325 |
| 4,373,222 | 2/1983 | Wolfe et al. | 269/328 |

*Primary Examiner*—Robert C. Watson

*Attorney, Agent, or Firm*—Koda and Androlia

[57] ABSTRACT

A reclining bed for childbirth includes a seat board and a backrest. The seat board is provided with a curved cut-out which opens to the center front of it and with thigh crutches provided at the right and left sides of the buttock supporting seat portion of the seat board. The thigh crutches securely support the thighs of woman in labor. The further improved version of this reclining bed for childbirth includes grip handles and armrests. The grip handles are provided at the right and left sides of a seat board installing base. The armrests are provided at the right and left sides of the backrest in an adjustable manner with regard to their tilting angle. This reclining bed for childbirth is effective in enabling a delivery to be performed easily with sitting position, thereby facilitating the works for both the woman in labor and the obstetrical assistants. It is also readily converted whenever it is necessary to be used either as bed or as chair.

2 Claims, 9 Drawing Figures

RECLINING BED FOR CHILDBIRTH

BACKGROUND OF THE INVENTION

1. Field of the Invention

The present invention relates to a reclining bed for childbirth (obstetrical table for sedentary parturition), and more particularly to a reclining bed for childbirth which helps a woman in labor perform an easy delivery and also facilitates the work of obstetric assistance.

2. Prior Art

Most of the conventional obstetrical tables are of flat bed type suitable for delivery in a dorsal decubital posture or with dorsosacral position. Delivery with the position of dorsal decubitus is easy to perform the midwifery work. However, for the laboring woman herself taking the posture of lying down on her back, it is impossible to exert the sufficient force for expulsion. With such position, it takes a long time for descending the movement of baby's head coming out. As a result, a severe fatigue is caused to the woman in labor. Furthermore, because of the dorsal decubital position, the woman giving birth to a child cannot exactly observe the fetus in process coming out or the handlings of the neonate with her own eyes. This causes further mental uneasiness to the laboring woman.

Recently, the sitting position delivery has become reconsidered as an alternative to the dorsal decubital delivery, and several types of obstetric chairs have been developed. However, all of those developed chairs are the mere modification of the reclining chairs made up of a seat board and backrest, and none of them has the form convenient to produce expulsive forth effectively. The reasons for the above are assumed that although such obstetrical chairs are designed to be used for the delivery with the posture similar to that of the sedentary delivery, they are not formed in the shape to provide the sufficient support for buttocks allowing the buttocks to slide and to be unstable in positioning. Besides, no change is made for the shape of thigh crutches, and those thigh crutches are still having the same shape as that of the thigh (knee) crutches provided in the obstetrical tables for dorsal decubital delivery.

SUMMARY OF THE INVENTION

A reclining bed for childbirth of this invention is based upon the idea that the best way to obtain the sufficient explusive force in a sitting position delivery would be to let the woman in labor take the posture similar to that of a little child in an exacuation with thighs supported by the mother from behind. Through examining various ways, this idea was found to work quite effectively and the present invention was completed.

Accordingly, the general object of the present invention is to provide a reclining bed for childbirth to help both the woman in labor and the person (persons) assisting the delivery, through facilitating the positive action in labor by giving the secure support for effective positioning.

The above object is achieved by the following features of the reclining bed for childbirth according to the present invention. That is, this reclining bed for childbirth includes a seat board having a curved cut-out which opens its center front and a backrest which is adjustable for its tilting angle. Furthermore, the seat board includes thigh crutches for supporting thighs by holding them from the below right and left of the buttock supporting seat to the inner sides of the thighs. Also, various other improvements are added to carry out the effective delivery in a sitting position.

With these improvements are incorporated, the reclining bed for childbirth is further designed to be used conveniently from the first stage to the final stage of the delivery in order to meet every motion of the respective stage. The essential features of the improvements are grip handles provided on both sides of a seat board base and armrests provided at the right and left sides of the backrest in a manner to be adjustable in tilting angle.

DETAILED DESCRIPTION OF THE INVENTION

Figure 1:
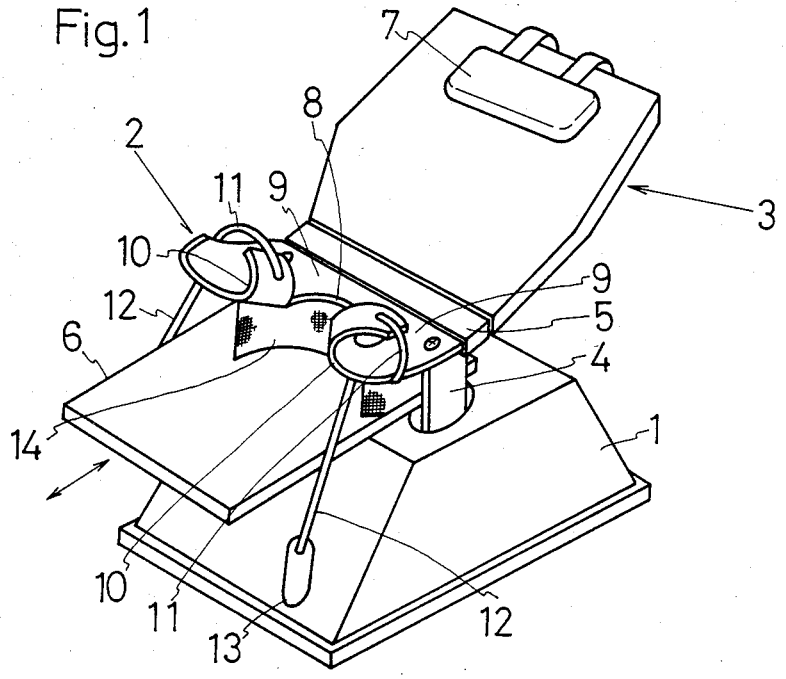
FIG. 1 is a perspective view of the reclining bed for childbrith according to the present invention.

Detailed description of the present invention will hereunder be given with reference to the drawings.

The reclining bed for childbirth substantially includes three components: a base section 1, a seat board 2, and a backrest 3. The base section 1 is of trapezoidal box type with height-adjustable (telescopic) legs 4 and a driving gear housed in it. On the height-adjustable legs 4, a seat board base 5 is provided. To the seat board base 5, the backrest 3 is fixed in reclining style. In front of the seat board base 5, the seat board 2 is attached in a detachable manner. Below the seat board base 5 and the seat board 2, a draw board 6 is installed in a manner to freely slide back and forth.

Similarly to the conventional medical examination table, a pillow 7 is provided on the upper part of the backrest 3 such that it slides freely upward and downward. For the tilting angle of the backrest 3, approximately 0–90 degrees should suffice as range. During the normal sedentary delivery, the backrest 3 is used with the tilting angle of about 40–60 degrees. It is further convenient that the height-adjustable legs 4 themselves are designed to be tilted to some extent so that the body of this reclining bed for childbirth is inclined backward by about 10 degrees. The draw board 6 can be pulled out frontward during the delivery operation and used as a utility tray or as receptacle for preventing the fetus from dropping on the floor and for receiving the afterbirth. After the use, the draw board 6 is pushed into the rear part of the reclining bed to be stored. The upper rear portion of the seat board base 5 is upholstered with flexible pad to provide a sufficient cushioning when the coccyx of a laboring woman comes to be positioned there.

Figure 3:
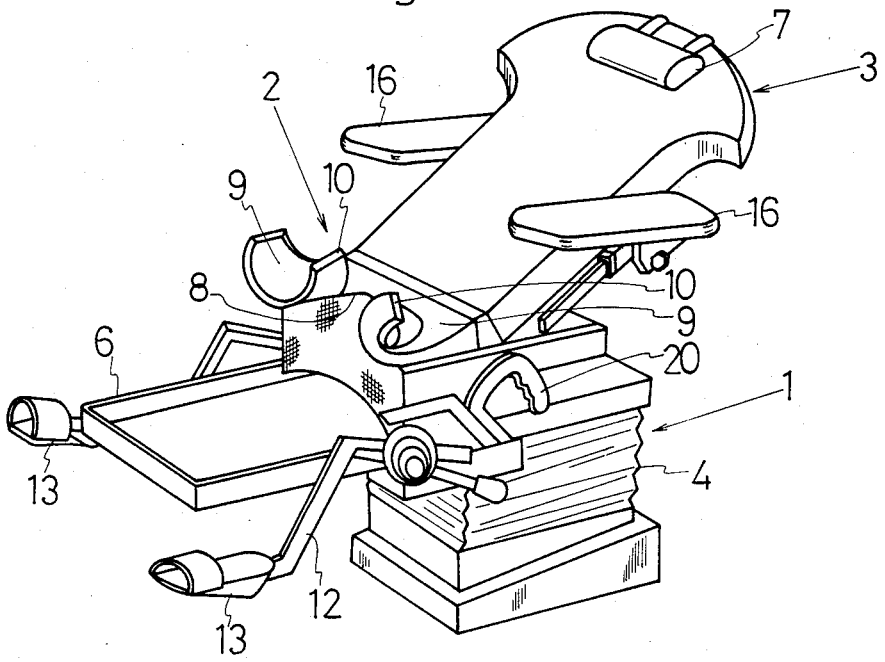
FIG. 3 is an overall perspective view of the reclining bed for childbirth.
Figure 4:
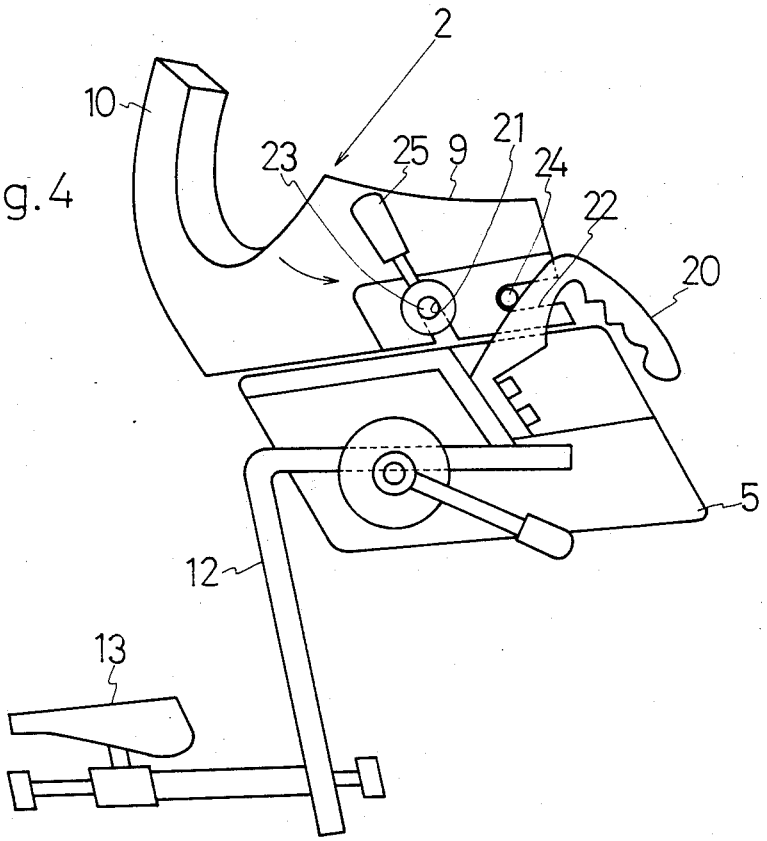
FIG. 4 is a side view of a bracket portion for installation/removal of a seat board.

The seat board 2 is contoured into a unique shape as seen in FIG. 1 or FIG. 3. With this contour, the sufficient explusive force can be obtained during the sitting-position delivery. That is, the right and left ends of the curved cutout 8 provided at the front center portion of the seat board 2 serve as buttock supporters 9. Thigh crutches 10 for supporting the thighs of the woman in labor by holding her thighs are provided in a form to extend from the bottom of the buttock supporters 9 to the inner side of the thighs. As mentioned earlier, these thigh crutches 10 look like the mother's hands holding a little child during the bowel movement of that child. The thigh crutches 10 serve to control the distance between the thighs (tightness of the crotch). In order to fix the thighs more securely in a position for preventing them from getting set apart wider, fastening straps 11 are provided across the respective crutches 10. Also, leg supporting arms 12 are provided on the under face of the thigh crutches to project downward in a slant manner. At the ends of the leg supporting arm 12, footrests 13 are provided in a vertically movable manner. Furthermore, along the curved cut-out 8, a curtain 14 is suspended to keep the filth from scattering or spattering around. This seat board 2 is screwed to the seat board base 5 so that it can be readily removed. Other applicable features are detachable/attachable structure as shown in FIG. 4, that will be mentioned later; rotational downward folding system; and structure to split the seat board into two parts so as to swing open. When the seat board 2 is removed, an auxiliary bed can be coupled with the seat board base 5 so that the reclining bed for childbirth is converted into a bed after the delivery.

Figure 2:
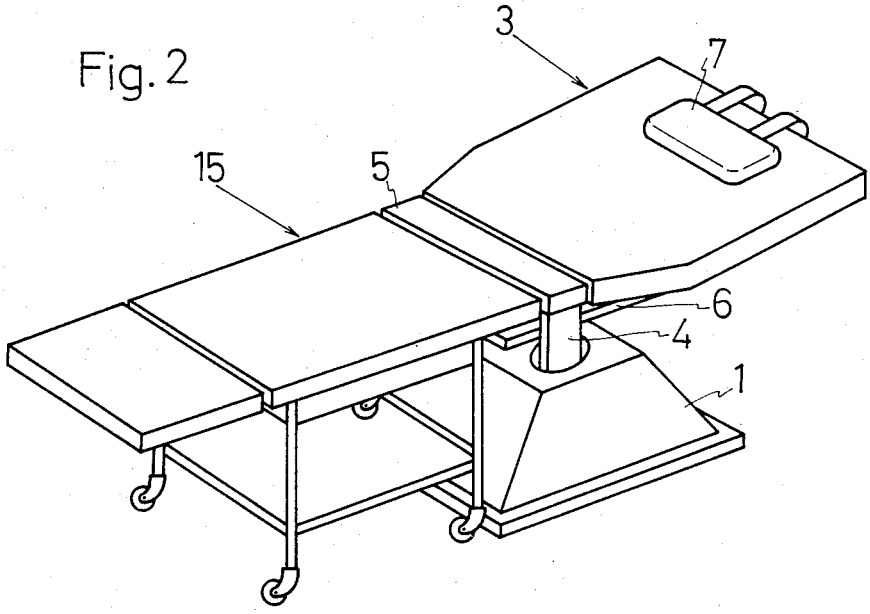
FIG. 2 is a perspective view of the reclining bed for childbirth in the state converted into bed.
Figure 5:
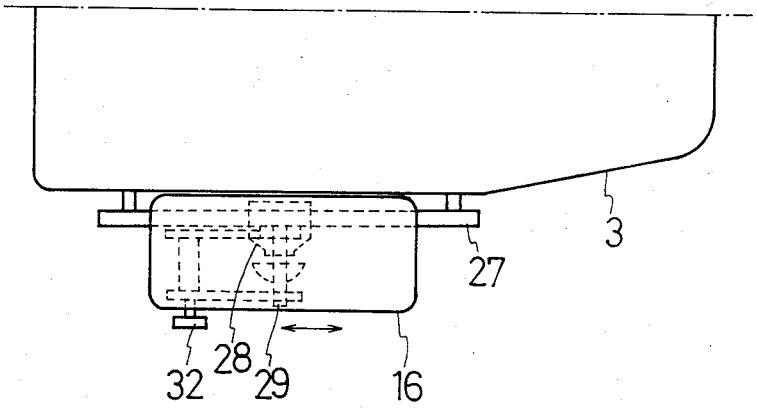
FIG. 5 is a plan view of the armrest.
Figure 6:
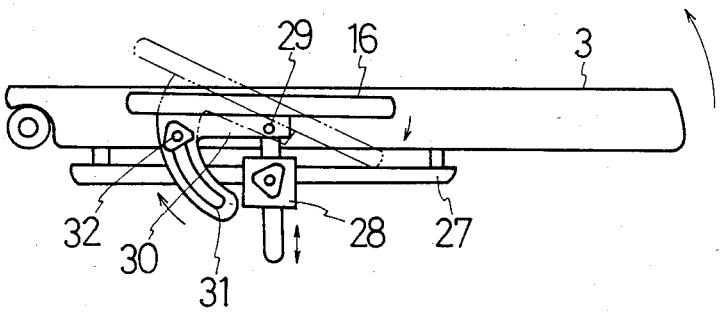
FIG. 6 is a side view of the armrest.

FIG. 2 shows the reclining bed for childbirth converted into a bed wherein the seat board 2 is removed and the auxiliary bed 15 is coupled with the seat board base 5 from the front. FIG. 4 shows an example of simple mechanism for attachment/detachment of the seat board. In FIG. 4, to help the laboring woman strain herself for positive action, grip handles 20 are provided on both sides of the seat board base 5. The reclining bed for childbirth shown in FIG. 3 is equipped with all the foregoing parts and mechanism. Specifically, notches 21 and 22 are formed on both sides of the bottom of the seat board 2. The notches 21 formed in the front portion are opened to the downward, and the rear notches 22 are opened to the backward. These notches on the seat board 2 are inserted onto two round sticks 23 and 24, provided parallel to each other in the seat board base 5, from the left to the right in FIG. 4 as marked with an arrow. Then, the round stick 23 is rotated by a lever 25 to move the curved portion that is formed in the round stick 23 to the extent equivalent to the width of the notch 21. As a result, the seat board 2 is securely fixed to the round sticks. The grip handles 20 are disposed at the position convenient for the laboring woman to strain herself for positive action by grasping the right and left grip handles 20 with her hands, respectively, while sitting on the buttock supporters 9 of the seat board 2 with her thighs placed and held by the thigh crutches 10. Armrests 16 are provided on the right and left sides of the backrest 3 as shown in FIG. 3, FIGS. 5 and 6. The armrests 16 are attached to the slidable metal fittings 28 which is inserted in the supporting rod 27. The holding rods 27 are parallel to the side faces of the backrest 3. The armrest 16 rotates around a shaft 29 and is locked at an appropriate position with a knob 32 which moves along the arc-shaped guide 31. In this manner, the tilting angle of armrest 16 can be adjusted in relation to the backrest, and also the armrest 16 can be brought to almost leveled position with the backrest 3. As a result, the armrest 16 effectively support the arms of a woman in labor when she exerts the expulsive force to give birth to a child. Also, the armrests 16 broaden the width of the reclining bed for childbirth when it is converted into that bed style.

Since the reclining bed for childbirth of this invention has the foregoing structure, an easy delivery can be performed quite effectively. The use of the bed will be described more specifically below in sequence.

Figure 7:
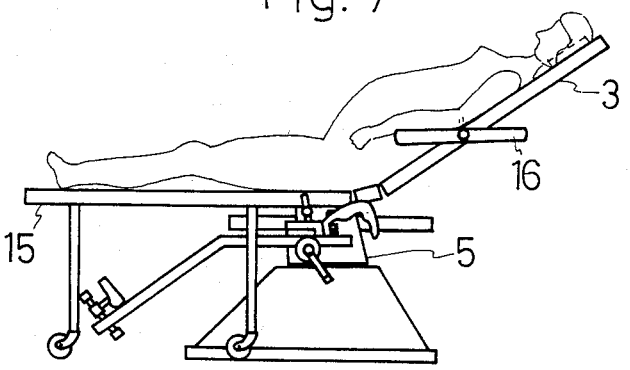
FIGS. 7, 8 and 9 are schematic side views of the reclining bed for childbirth being used.
Figure 9:
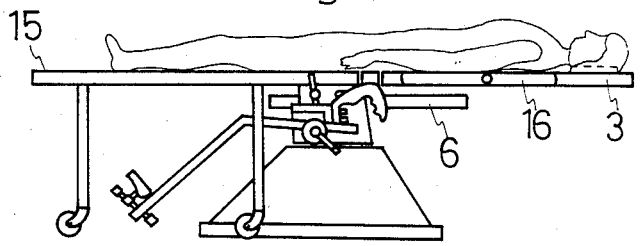

First, during the waiting period starting from the time entering into a hospital to the time of maximum dilatation of uterocervical canal, called first stage of labor, comfortable posture for the pregnant woman is either to lie down on the side or to lie down on the back. It is also an easy posture to sit in the reclining chair and lean on the gently tilted backrest as shown in FIG. 7. In this case, the seat board 2 is detached and the auxiliary bed 15 is coupled with the reclining bed for childbirth. Front portions of the armrests 16 are elevated above the backrest surface so as to be used as regular armrests. When the backrest is tilted backward by 90 degrees to use as a bed, the armrests 16 serve to widen the bed to right and left sides as shown in FIG. 9. These armrests also contribute a great deal to inject the labor inducer or to stick and keep the indwelling needle in vein for securing the blood vessel used in case of emergency.

Next, when the process of labor advances to the second stage, the auxiliary bed 15 is detached from the seat board base 5, and the seat board 2 is attached to the seat board base 5. Then, the thighs of the woman in labor are fixed with the thigh crutches 10 to prevent the distance between the thighs from getting closer by adduction. The feet are placed on the footrests 13 with the hands firmly grasping the grip handles 20, and the elbows are placed on the armrests to aid the positive action of the woman in labor by bracing her legs. The particularly great aiding effects are provided by the grip handles 20 and also by the armrests 16 being on the same level as the backrest 3.

Figure 8:
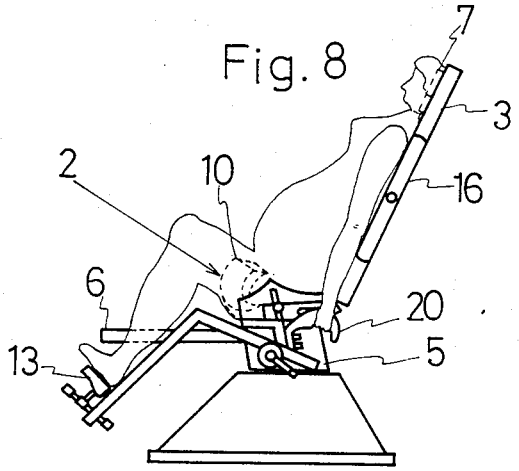

The basic appearance of this reclining bed for childbirth, which is in use, is as shown in FIG. 8. The backrest 3 is raised about 60 degrees in tilting angle, and also the pillow 7 is adjusted to the position of the head of the woman in labor. Thus, the proper posture for the delivery in a sitting position can be secured. The draw board 6 is pulled out and used as a utility tray or as a receptacle for fetus and afterbirth. The armrests 16 are brought to the same plane with the backrest 3 to increase the width of the backrest.

After the childbirth, the seat board 2 is detached from the seat board base 5, and the auxiliary bed 15 is attached to the seat board base 5. With this arrangement, the woman after labor can lie on the side or the back. This stage is important because the secondary hemorrhage is large in quantity and the course of the progress must be observed very carefully. In this aspect, the reclining bed for childbirth of this invention is quite convenient since it can be converted into a flat bed as shown in FIG. 9. Therefore, it is not necessary to move the woman after the childbirth to other bed.

As described above, the reclining bed for childbirth of this invention is provided with the seat board with unique contour effected by the curved cut-out opened to the center front, the thigh crutches disposed on the right and left sides of the cut-out, and the grip handles to further assist the positive action in exerting the expulsive force. In addition, this reclining bed for childbirth is provided also with the rotatable, wide armrests which function even when the bed is in a chair form. Therefore, easy delivery in a sitting posture which is not possible in the existing bed can be performed, helping both the women in labor and the obstetric assistants.

I claim:

1. A reclining bed for childbirth comprising:

a detachable seat board from a seat board base contoured with curved cut-out that opens to the center front;

a backrest adjustable as to its tilting angle;

an auxiliary bed attachable to the seat board base; and thigh crutches provided on the seat board for supporting thighs by holding them from below right and left sides of the buttock supporting seat portion of the seat board up to the inner sides of the thighs.

2. A reclining bed for childbirth comprising a detachable seat board from a seat board base which includes thigh crutches provided at the right and left sides of a curved cut-out which opens to the center front of the seat board, a backrest which is adjustable in its tilting angle, and an auxiliary bed attachable to the seat board base said reclining bed further comprising:

grip handles provided on both sides of a base for installing the seat board; and armrests provided at the right and left sides of the backrest, a tilting angle of said armrests being adjustable and can be brought almost to a level position with the backrest.

* * * * *